US006498557B2

(12) United States Patent
Johnson

(10) Patent No.: US 6,498,557 B2
(45) Date of Patent: Dec. 24, 2002

(54) THREE-DIMENSIONAL MICRO-COILS IN PLANAR SUBSTRATES

(75) Inventor: Burgess R. Johnson, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 68 days.

(21) Appl. No.: 09/838,629

(22) Filed: Apr. 19, 2001

(65) Prior Publication Data

US 2002/0057173 A1 May 16, 2002

Related U.S. Application Data

(63) Continuation-in-part of application No. 09/342,087, filed on Jun. 29, 1999, now Pat. No. 6,445,271.
(60) Provisional application No. 60/136,471, filed on May 28, 1999.

(51) Int. Cl.[7] ..... H01F 5/00
(52) U.S. Cl. ..... 336/200; 336/65; 336/83
(58) Field of Search ..... 336/65, 83, 183, 336/200, 208, 223, 232; 257/531

(56) References Cited

U.S. PATENT DOCUMENTS

| | | | | | |
|---|---|---|---|---|---|
| 3,614,554 | A | * | 10/1971 | Shield et al. | 336/200 |
| 3,638,156 | A | * | 1/1972 | West | 336/200 |
| 3,881,244 | A | * | 5/1975 | Kendall | 336/223 |
| 6,292,084 | B1 | * | 8/2001 | Choi et al. | 336/200 |

* cited by examiner

*Primary Examiner*—Lincoln Donovan
*Assistant Examiner*—Tuyen T. Nguyen
(74) *Attorney, Agent, or Firm*—Dennis C. Bremer

(57) ABSTRACT

A three-dimensional micro-coil situated in a planar substrate. Two wafers have metal strips formed in them, and the wafers are bonded together. The metal strips are connected in such a fashion to form a coil and are encompassed within the wafers. Also, metal sheets are formed on the facing surfaces of the wafers to result in a capacitor. The coil may be a single or multi-turn configuration. It also may have a toroidal design with a core volume created by etching a trench in one of the wafers before the metal strips for the coil are formed on the wafer. The capacitor can be interconnected with the coil to form a resonant circuit An external circuit for impedance measurement, among other things, and a processor may be connected to the micro-coil chip.

15 Claims, 8 Drawing Sheets

25542

A-A

25542

2554Z

THREE-DIMENSIONAL MICRO-COILS IN PLANAR SUBSTRATES

This application is a continuation-in-part of a U.S. patent application, Ser. No. 09/342,087, filed Jun. 29, 1999, now U.S. Pat. No. 6,445, 271 which in turn claims priority from U.S. Provisional Application No. 60/136,471, filed on May 28, 1999.

FIELD OF THE INVENTION

The invention pertains to inductive coils. In particular, it pertains to micro-coils in planar substrates, and more particularly, to three-dimensional micro-coils in such substrates operating with an external circuit.

BACKGROUND OF THE INVENTION

Micro-coils on planar substrates in the art are two-dimensional, wherein the operation of them results in eddy current losses in the substrate. Other micro-coils are three-dimensional plated metal structures whose height is limited and are difficult to fabricate uniformly. Three-dimensional micro-coils also are fabricated on small rods and ceramic blocks; however, it is difficult to fabricate large numbers of such devices and integrate them with electronics on planar substrates.

There are micro-coils that consist of spiral inductors fabricated on planar substrates, three-dimensional coils fabricated on the surfaces of tubes, ceramic blocks, or other substrates with cylindrical symmetry, and inductors formed by plating metal structures with high aspect ratios onto substrates.

There are spiral inductors on planar substrates. This is a type of inductor that is fabricated by deposition and photolithographic processes. One example of its use is to increase the magnetic flux coupled into a magnetometer. Its most serious disadvantage is that a substantial fraction of the stored magnetic energy is contained in the substrate. Thus, if the substrate has a finite conductivity, as is usually the case for silicon, eddy current losses can be substantial.

There are three-dimensional coils on cylindrical objects. Helical inductors have been fabricated by patterning metal deposited onto a tube, and inductors with a square cross-section have been fabricated by laser patterning of metal deposited onto an aluminum oxide rod having a square cross-section. The fabrication processes for these devices are not conducive to batch fabrication, and cannot be easily integrated with the fabrication processes for integrated circuits.

Also, there are high-aspect-ratio plated metal inductors. These devices consist of air bridges of thick metal formed on a patterned metal layer on the surface of a wafer. Many air bridges can be connected electrically to form multi-turn air-core inductors whose stored magnetic energy lies mostly outside the substrate. The air bridges are formed by electroplating metal into molds formed from thick photoresist. These inductors can have low eddy current losses, and the fabrication process can be integrated with silicon integrated circuit fabrication. However, the height of the plated structures is limited to the thickness of the photoresist, typically a maximum of 50 to 100 microns, thus limiting the height of the inductor. Also, the thickness of the electroplated metal is non-uniform over the surface of a wafer. This reduces the fabrication yield, and causes the dimensions of the structures, and therefore the electrical characteristics, to vary over the surface of a wafer.

Inductors are often used in magnetic resonance spectrometer circuits where a pair of coils cooperatively provide a change in reflected RF power in response to a change in impedance. However, prior art inductors used in these circuits still have the above-noted disadvantages, and the present invention depicting three-dimensional micro-coils in a substrate avoids the above-noted disadvantages.

SUMMARY OF THE INVENTION

The present invention has applications to portable magnetic resonance sensors and analyzers. Applications to other areas of high frequency electronics include low-loss tuned resonant circuits and filters in radio frequency (RF) wireless communication electronics. The preferred fabrication method for the present invention starts by etching a trench in a wafer substrate to define the air core of the inductor. Metal is then deposited onto the trench and patterned, followed by soldering a second wafer to the first wafer to complete the electrical connections for the inductor windings. With this fabrication method, one-turn inductors having a tubular topology may be fabricated. The magnetic field produced by such an inductor is confined mostly to the interior of the inductor. Thus, eddy current losses in the substrate can be minimized, resulting in the fabrication of high Q resonators.

Micro-coils may be components of micro-resonators. The invention covers various types of three-dimensional micro-coils as well as electrical resonators formed from these kinds of micro-coils in planar substrates. The resonators typically operate at VHF, UHF or microwave frequencies.

Micro-resonators having three-dimensional single-turn tubular micro-coils have been successfully fabricated on silicon wafers. The Q of these resonators is typically about 30 at a resonant frequency of 680 MHz. The inductance of one of these micro-coils is about 0.2 nano-henry (nH). Micro-resonators having micro-coils with two turns and three turns have also been successfully fabricated in silicon wafers. The wafers maybe planar substrates made of various materials such as GaAs besides silicon. These multi-turn devices have higher inductance than the one-turn devices, but have a substantially lower Q (Q of about 7 at 432 MHz and Q of about 9 at 545 MHz). The lower Q is caused by the RF magnetic field between the windings penetrating into the silicon substrate, producing eddy current losses in the silicon substrate. A wide range of micro-coil inductances (and hence, resonant frequencies) can be obtained by changing the dimensions of the micro-coils. The advantages of the present invention are noted The micro-coils are batch fabricated by processes compatible with integrated circuit fabrication techniques. Thus, the micro-coils can be fabricated in large quantities at low cost and integrated with active electronic circuitry The coils have low eddy current losses because they have an air core. The three-dimensional geometry confines the magnetic field to the inside of the coil, thus minimizing eddy current losses in the substrate or other surrounding conductive materials. The height of the air core, determined by the depth of the etch trench, can be as large as the thickness of the substrate wafer, which is typically 500 microns for a 4-inch silicon wafer, and much thicker for the larger wafer diameters typically used in integrated circuit fabrication.

The inductance depends on the dimensions of the etched trench, and the shape of the patterned metal in the etch trench. The dimensions of the etched trench can be uniform for many devices over the surface of a wafer, and the shape of the patterned metal is determined by well-defined photolithographic processes.

Three-dimensional micro-coils have applications in miniature magnetic resonance spectrometers used as sensors and analyzers. Nuclear magnetic resonance (NMR), electron spin resonance (ESR), or nuclear quadropole resonance (NQR) can be measured with such a device. Magnetic resonance spectroscopy is a powerful tool for detection and identification of chemical species. An electron spin resonance (ESR) signal is typically caused by a free radical, and hence is sensitive to the chemical environment. An NMR signal is typically affected by small frequency shifts due to neighboring nuclei and electrons. Thus, each nucleus in a molecule will have a slightly different magnetic resonance frequency. As a result, a complex molecule can have a unique NMR spectrum.

The greatest obstacle to miniaturization of magnetic resonance spectrometers is the size of the magnet providing the DC field needed to polarize the specimen being measured. A large, uniform polarizing magnetic field is desirable in order to achieve high signal to noise and narrow magnetic resonance linewidth. A typical laboratory ESR spectrometer uses a magnet weighing over 1000 kilograms, which provides a uniform field of approximately 0.3 Tesla over a pole-piece diameter of several inches. A typical laboratory NMR spectrometer uses a superconducting magnet providing a field of order 10 Tesla or more. If the size of the pick-up coil can be reduced, then the diameter of the magnet's pole pieces and the gap between the pole pieces can be reduced, thus allowing the volume of the entire magnet to be dramatically reduced. The gap between the pole pieces is important because the number of amp-turns required to achieve a given magnetic field is approximately proportional to the gap spacing. Thus, a small gap reduces the size of the magnet windings and the power supply requirements. The present invention permits the micro-coil thickness, and hence the gap between the pole pieces, to be about one millimeter. The diameter of the pole pieces would be about two centimeters, which is a few times larger than the typical length of the micro-coil. Such a magnet is small enough to allow construction of a handheld magnetic resonance analyzer.

There are further advantages of the present invention for use in miniature magnetic resonance spectrometers. The signal to noise ratio per magnetic resonant spin is higher for small pickup coils than for large pickup coils. Thus, for analyzing very small samples, small coils provide the optimum signal to noise. Also, micro-coils on planar substrates permit inexpensive integration of the pickup coil with the signal processing electronics.

Analyzers with multiple pickup coils are more cost effective with all the coils integrated onto a single substrate, as made possible by the present invention Integration of the pickup coils with micro-fluidic gas and liquid sampling systems and other microanalysis systems is facilitated.

The invention has applications for miniaturized wireless communications circuitry. On-chip integrated inductors allow more design flexibility and easier fabrication of filters and tuned resonant circuits at UHF, VHF and microwave frequencies. Such inductors also have applications in microprocessors, especially as clock speeds increase toward one GHz and beyond.

This invention makes possible the fabrication of arrays of resonant circuits. The resonant circuits can be fabricated by batch fabrication processes. Many of these circuits can be fabricated on a single planar substrate simultaneously. Photolithographic patterning allows the dimensions of each resonant circuit to be precisely defined, therefore providing accurate control of each resonant frequency as well as the properties of circuits that couple energy between them. One application of such an array of resonant circuits would be to form a resonator with flat frequency response over a specified frequency range. Several resonant circuits, each with a slightly different resonant frequency, would be electrically coupled to each other to provide the desired flat frequency response. The coupling would be performed by transmission lines consisting of patterned dielectric and metal layers on one or both of the planar substrates. A transmission line could be connected directly to the capacitor of each resonant circuit, or to a secondary inductor formed near the primary inductor of each resonant circuit so that the mutual inductance between the secondary and primary inductors provides coupling of energy between the transmission line and the resonant circuit.

A resonator formed from an array of several coupled resonant circuits can be used as an electrical filter having a flat band-pass response. The flat frequency response would also be advantageous for use as the pick-up coil in an NMR or ESR spectrometer. Precise dimensional control is essential for fabrication of such a device, in order to control the resonant frequencies of the individual resonant circuits and the characteristics of the coupling circuitry connecting them together. Batch fabrication using photolithography allows such devices to be built at relatively low cost. Other batch fabrication processes on planar substrates, such as screen-printing, can be used when the device dimensions are large enough to allow such processes. The invention may be fabricated on flexible or rigid planar substrates. Flexible substrates can include polyimide, such as KAPTON, or other polymers.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1A:
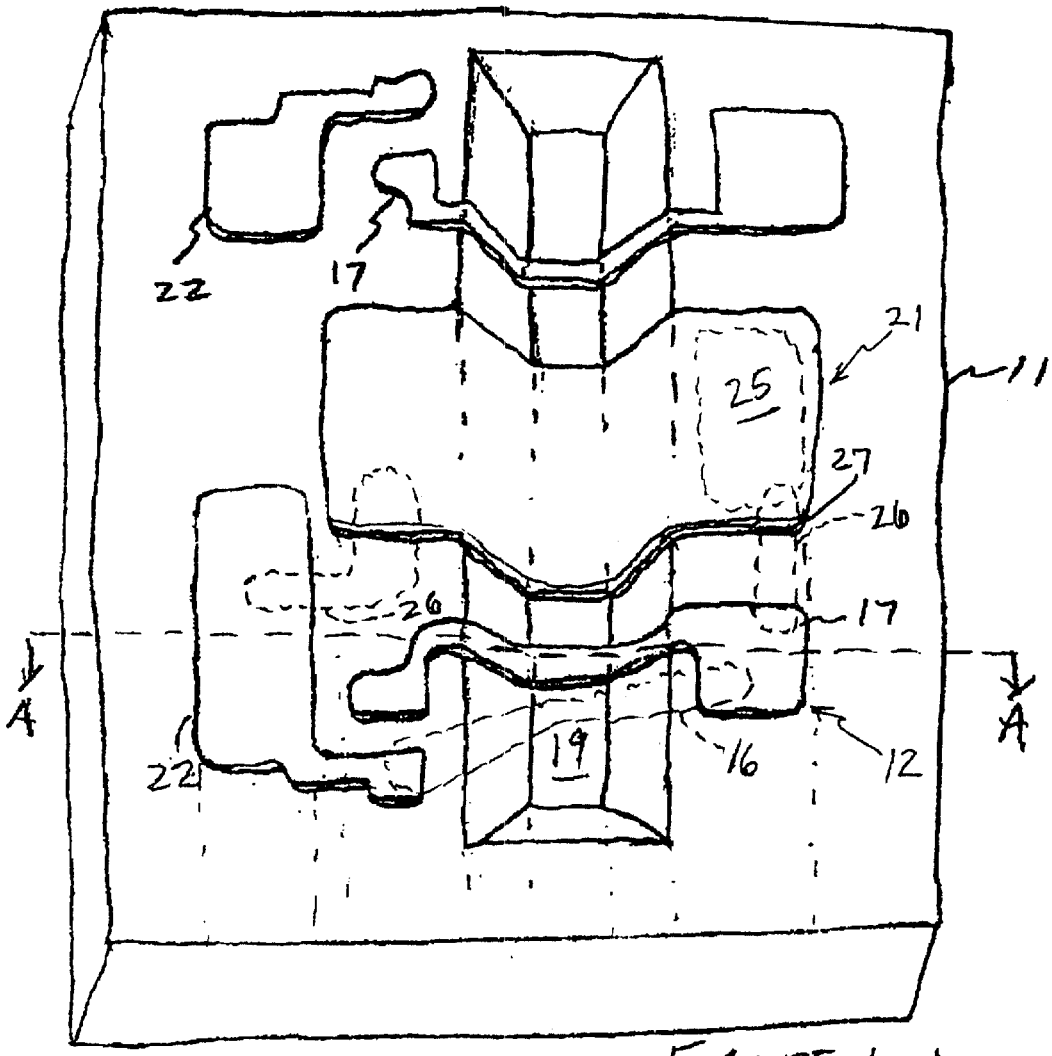
FIGS. 1*a* and 1*b* show an integrated circuit having a three-dimensional coil and a capacitor.
Figure 1B:
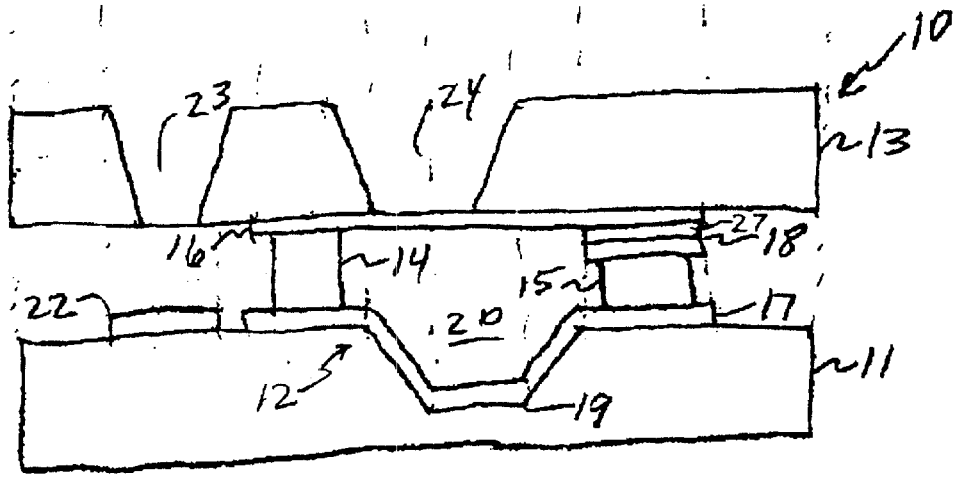

FIGS. 1*a* and 1*b* show a resonant circuit device formed from a micro-coil inductor 12 and a capacitor 21 connected to the inductor. FIG. 1*a* shows a "bottom" wafer or substrate 11 of an integrated circuit 10 having a micro-coil 12. Micro-coil 12 has one turn. An "upper" wafer or substrate 13 is placed on top of wafer 11. Metal 17 on wafer 11, solder 14, metal 16 on wafer 13, and solder 15 form coil 12. Item 18 may be a capacitor 21 or be a connection of capacitor 21 to the coil 12 circuit. Capacitor 21 is present for completing the basic structure of a micro-resonator on chip 10. Capacitor 21 may be connected in series or parallel with coil 12. Trench 19, etched in wafer 11, helps establish an inductor cavity 20 for coil 12. Trench 19 may extend out to the edge of substrate 11, to allow magnetic resonance specimens to be inserted into trench 19 linearly along its axis, from the trench opening on the edges of substrates 11 and 13. The magnetic field can be almost entirely confined to the inside of inductor or coil 12 if trench 19 has a toroidal geometry. Plate 25 is an electrode for capacitor 21. Another plate 25 formed on wafer 13 is another electrode of capacitor 21 in conjunction. with electrode 25 on wafer 11. Also, wafer 13 has conductive interconnect paths for appropriately connecting capacitor 21 and coil 12 with each other, or to item 18. Solder 14 provides electrical connection between a conductor on wafer 13 and a conductor on wafer 11, such as pad 22 or metal 17. Wafer 13 has a metal 16 that is another portion of coil 12. Wafer 13 has a hole 23 for access to pad 22 and metal 17. A hole 24 is etched in wafer 13 for access to inductor cavity 20. Hole 24 in FIG. 1*b* allows insertion of a material to be sensed with ESR or NMR, as well as allowing the magnetic flux to exit the inductor without passing through the substrate 13 or 11 material. Wafers 11 and 13 may have additional pads 22, coil elements 16 and 17 and capacitor elements 25 for other micro-coils 12 and capacitors 21. These components may be variously interconnected to form micro-resonators or other devices.

Three-dimensional coil 12, formed in planar substrates 11 and 13, may have a thickness dimension on the order of one millimeter. Substrates 11 and 13 may be wafers of silicon, GaAs, GeSi, silicon-on-insulator (SOI), printed circuit board, plastic flexible circuit substrate, or other like material. Substrates 11 and 13 are bonded together by soldering at, for example, places 14 and 15.

Lower substrate 11 is silicon or other material with etched trench 19 that has patterned metal 17, 22 and 25 deposited on its surfaces, such that metalized trench 19 forms the core of inductor 12, and patterned metal 17 partially forms the winding of inductor 12. Etched trench 19 is typically about 0.5 to 2 millimeters wide, and has a depth that can be comparable to the substrate 11 thickness. Other dimensions are possible, constrained only by the substrate 11 thickness and the minimum size permitted by photolithography. If substrate 11 is silicon, then the preferred method for etching trench 19 is anisotropic wet chemical etching on a (100) oriented silicon wafer 11. Upper substrate 13 has a patterned layer 16 that completes the electrical current paths for the windings of inductor 12. ("(100)" describes the crystallographic orientation with respect to the wafer surface, in standard crystallographic terminology). Solder provides electrical connections 14 and 15 between metal layers on upper substrate 13 and lower substrate 11, as well as providing a mechanical bond between substrates 11 and 13. The solder is deposited and patterned onto at least one of the substrates 11 and 13 before the wafers are bonded together.

A resonant circuit can be provided by fabricating a capacitor 21 having a patterned dielectric layer 27 sandwiched between two layers 25 of patterned metal. With certain micromachining techniques, the dielectric may be just a space between electrodes 25. Capacitor 21 can be fabricated on either of substrates 11 and 13 or both. Capacitor 21 is electrically connected to inductor 12 by patterned metal layers 22 and 26 on the substrates. For connections to external circuitry such as a power source, inductor 12 or capacitor 21 can be connected to wire-bond pads 22. Alternatively, pads 22 can be connected to a second inductor 12 patterned onto etch trench 19 just beyond the end of the first micro-coil 12, so that the mutual inductance between the two micro-coils provides electrical coupling between a first micro-coil 12 and the external circuitry. Pads 22 are accessed externally for some of the connections through etched holes 23 in substrate 13. Additional etched holes 23 could reside on substrate 11 with corresponding pads 22 residing on substrate 13.

Access to inductive cavity 20 can be attained through etched holes 24. Etched holes 24 allow measurement specimens to be introduced to inductor cavity 20. Etched holes 24 also allow magnetic flux to escape inductor cavity 20 without penetrating the substrate material of 11 or 13. To further prevent penetration of magnetic flux into the substrate material of 11 or 13, metal 17 can cover the entire trench 19, and the sidewalls of access holes 24 can be coated with metal. Access holes 24 could be located on substrate 11 and/or substrate 13.

Metal layers 16, 17, 22, 25 and 26 are composed of gold, copper, silver or any other material having high conductivity at the operating frequency of device 10. Metal layers 16, 17, 22, 25 and 26 should be at least as thick as the electrical skin depth of the metal to minimize the electrical resistance of the device and to confine radio frequency (RF) fields to the inside of inductor 12 and capacitor 21, so as to minimize power dissipation in substrates 11 and 13. If the substrate material has substantial electrical conductivity, then an insulator layer is required between metal layers 16, 17, 22, 25 and 26, and the substrate 11, 13 material.

To reduce eddy current losses in substrates 11 and 13, designing micro-coil 12 to be a tube, or any other shape with cylindrical symmetry, is advantageous because this kind of configuration confines the RF magnetic field mostly to an air core region 20 of inductor 12. The winding of such an inductor has only one turn as shown by metal layers 16 and 17 in FIGS. 1*a* and 1*b*.

Figure 2A:
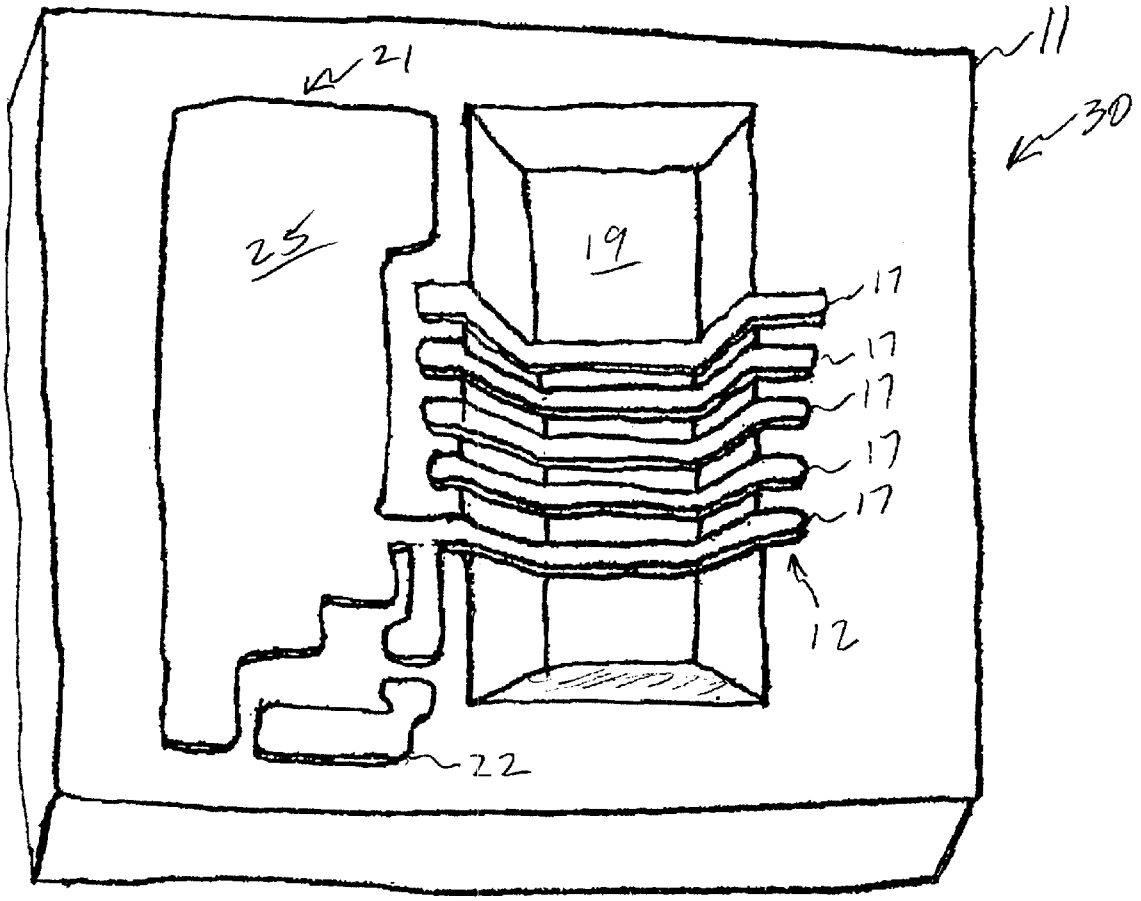
FIGS. 2*a*, 2*b* and 2*c* reveal a multi-turn coil within two wafers sandwiched together.
Figure 2B:
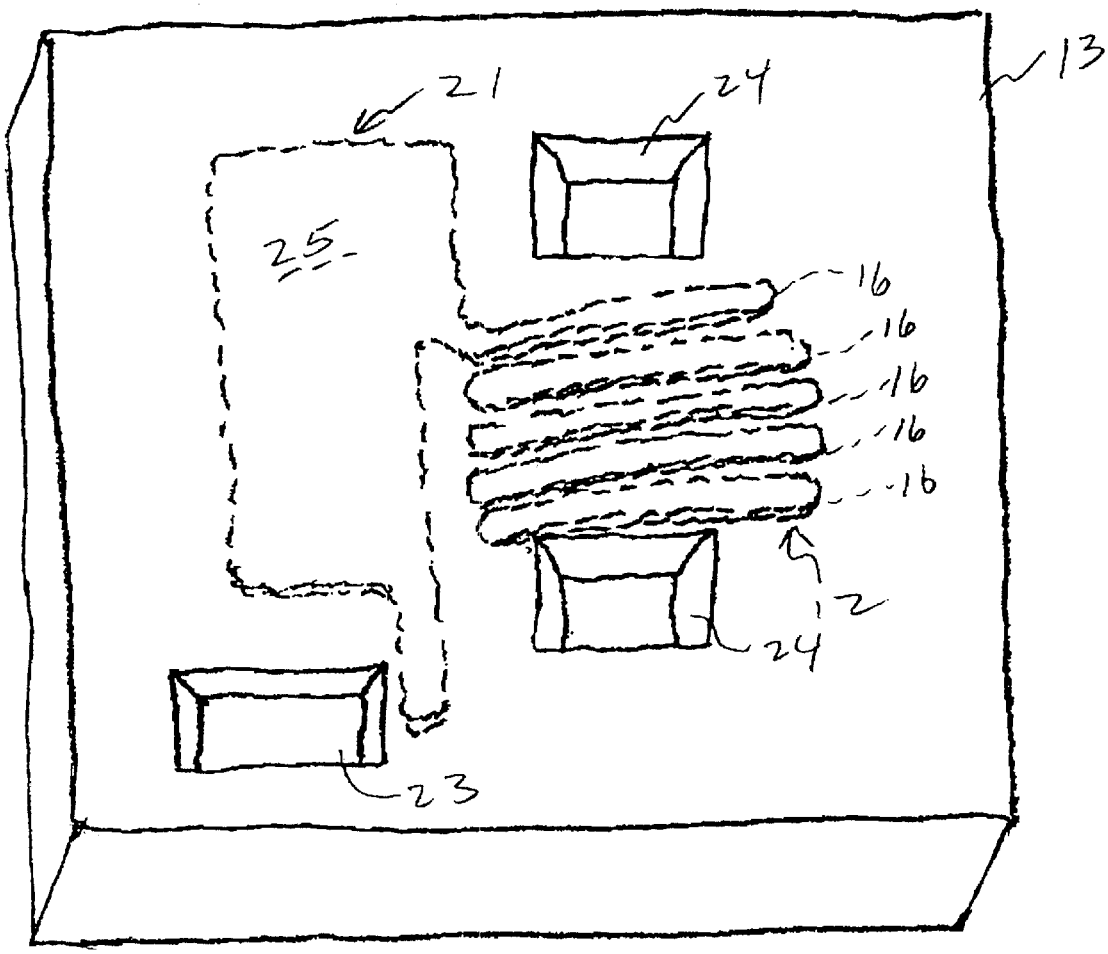
Figure 2C:
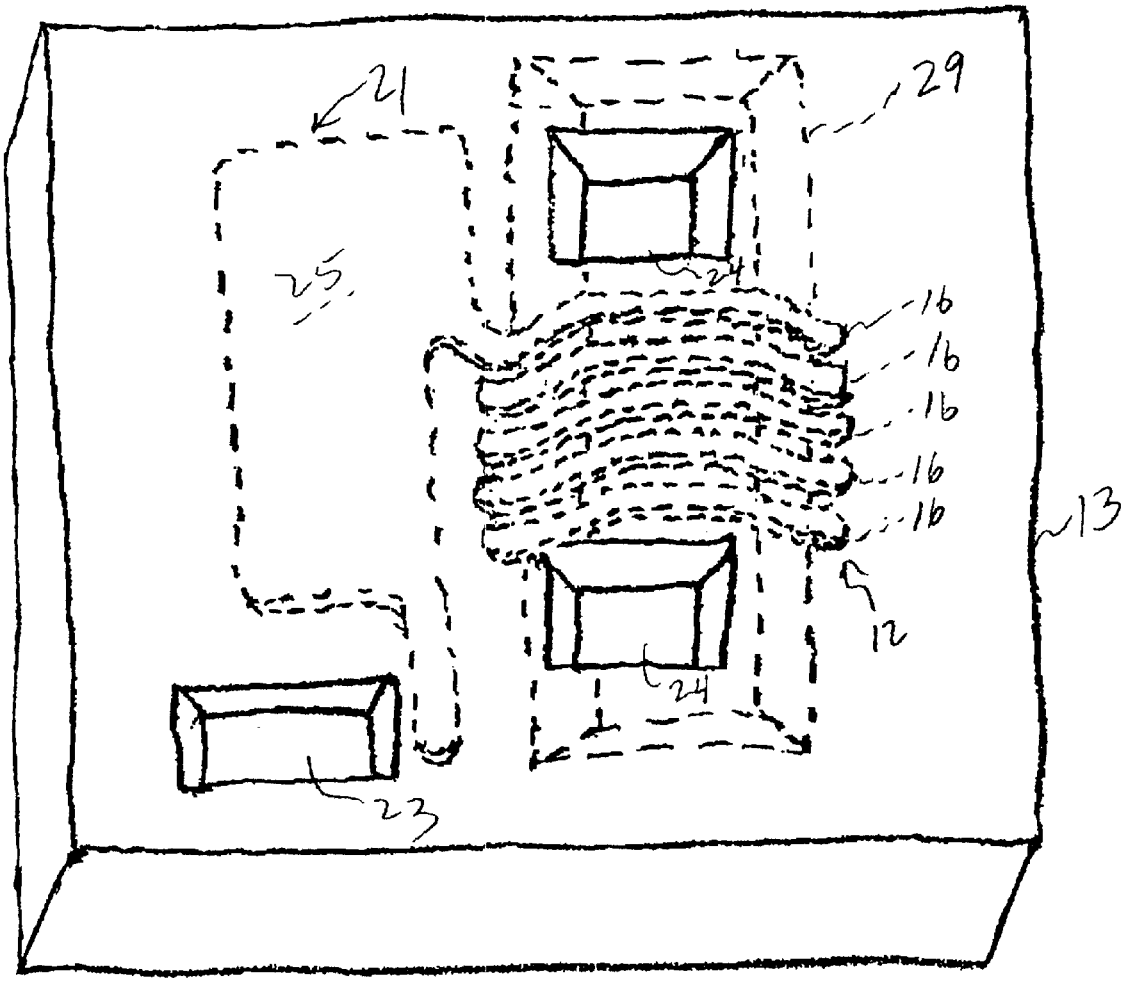

The resonance device 30, shown in FIGS. 2*a*, 2*b* and 2*c*, is a multi-turn micro-coil 12 device. FIG. 2*a* shows a top view of substrate 11. FIG. 2*b* shows a top view of the substrate 13 that is bonded to the top surface of substrate 11 shown in FIG. 2*a*. FIG. 2*c* shows an alternative embodiment of substrate 13 that has an etched trench 29. Multi-turn inductor 12 of FIGS. 2*a* and 2*b* has been fabricated. However, the RF field of such an inductor can penetrate into substrates 11 and 13 between coil windings 16 and 17, causing eddy current losses if substrate 11 or 13 is formed from a lossy material such as silicon. Eddy current losses at the ends of micro-coil 12 can be prevented by etching a trench 19 or 29 that forms a closed path on the surface of substrate wafer 11 or 13, respectively, so that a toroidal inductor is formed when the second wafer 13 or 11, respectively, is bonded to the first wafer. The magnetic field is then confined almost entirely to the inside of the toroid, thus avoiding the problem of eddy current losses at the ends of inductor 12 (FIGS. 2*a*, 2*b* and 2*c*) formed from linear trench 19 or 29 in substrate 11 or 13.

Figure 3:
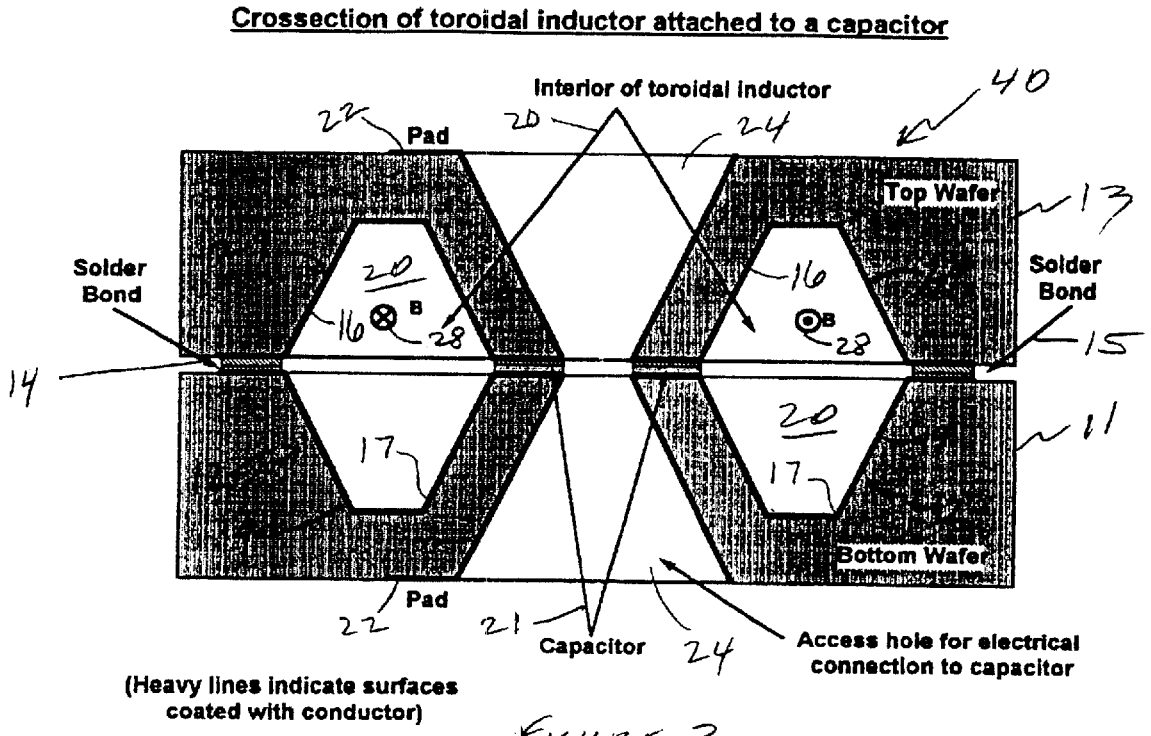
FIG. 3 shows a wafer coil having a toroidal configuration

A low loss resonant circuit can be fabricated from a one-turn tubular inductor 12 and a capacitor 21, as shown in FIGS. 1*a* and 1*b* FIG. 3*a* further illustrates this circuit with a cross section of device 40 having a toroidal inductor 12 attached to a capacitor 21. A top view of inductor 12 would appear circular. On the other hand, the path of the etched trench 29 of device 40 does not need to be circular, it could be any closed path on the surface of substrate 13. This circuit is a split ring resonator 40 because it has a oneturn inductor 12 formed from a conducting tube (or other shape with cylindrical symmetry) having a slit along its length and a capacitor 21 which is connected to the edges of the slit in inductor tube 20. A toroidal split-ring resonator 40 can be constructed by joining the ends of tubular inductor 12 to each other. The topology of device 40 is implemented in a planar substrate using micro-machining techniques such as thin-film deposition, wet chemical etching, and photolithographic patterning.

To produce an inductor 12 having higher inductance and reduced volume, a high-permeability low-loss magnetic material can be deposited into inductor core 20 of micro-coil 12 This device has application as a compact inductor in integrated circuits, such as filters and resonant circuits in wireless communications, or in high speed digital electronics.

Figure 4A:
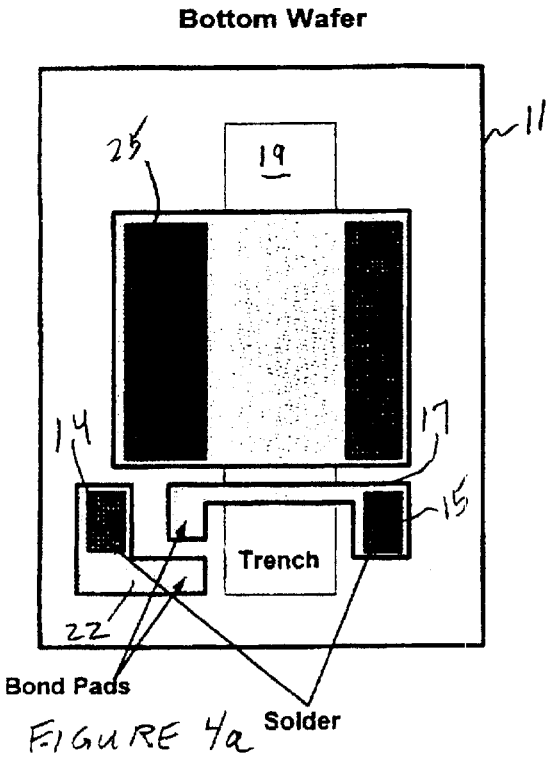
FIGS. 4*a*, 4*b* and 4*c* illustrate the interrelationship of the two wafers that encompass the coil and the capacitor.
Figure 4B:
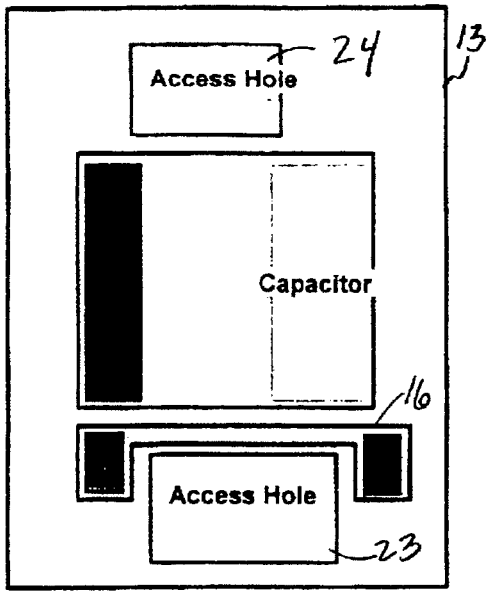
Figure 4C:
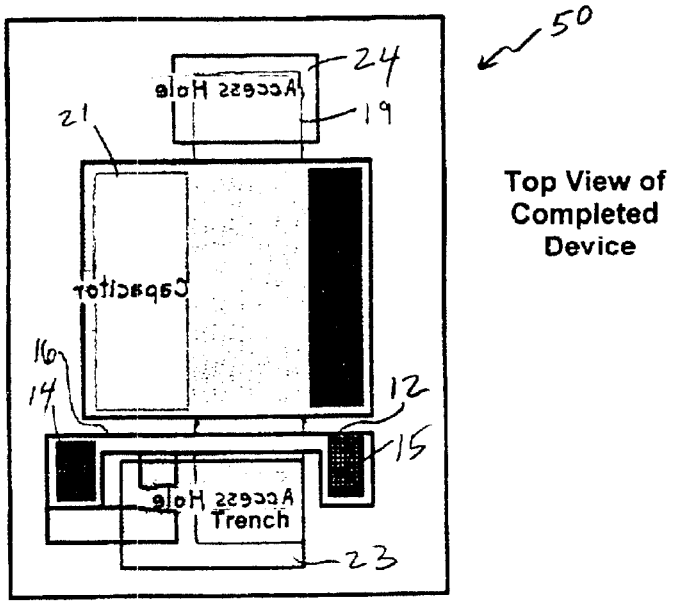

FIGS. 4*a*, 4*b* and 4*c* are diagrams of a resonator device 50 having coil 12 and capacitor 21. FIG. 4*a* shows the top side of bottom wafer 11 and FIG. 4*b* shows the bottom side of wafer 13. One can regard wafers 11 and 13 as two pages of an open book. When the book is closed (i.e., device 50 is assembled), the wafers are put together, and assembled device 50 is shown in FIG. 4*c*. The substrate is assumed to be transparent so that one can see through top wafer 13 in FIG. 4*c*.

A single-turn inductor may have slits perpendicular to the axis of the inductor. Such slits reduce eddy currents caused by an externally applied time-varying magnetic field, thus allowing the external time-varying magnetic field to penetrate into the central region of the inductor. This is useful for performing double magnetic resonance using techniques such as ENDOR (electron-nuclear double resonance), where the specimen must be exposed to two RF magnetic fields having two different frequencies, to excite two different magnetic resonant components within the specimen. The two RF fields would be provided by two resonators, each tuned to a different frequency.

A single-turn inductor may also have a plurality of longitudinal slits for connection to a plurality of capacitors. The resonant frequency of a resonator fabricated in this way will be proportional to the square root of the number of capacitors, if all the capacitors are identical.

There are various configurations that can incorporate the invention The micro-coil can be fabricated within a silicon (or an insulator such as glass or sapphire) wafer, where the diameter of the coil is comparable or less than the thickness of the wafer. The coil may be electrically connected to a capacitor on the same wafer, and be such that the resulting circuit of the coil and the capacitor is resonant. This coil and capacitor may be electrically coupled to an external circuit inductively with a loop of conducting material residing in the same wafer as the coil and having dimensions comparable to those of the coil. Or the coil and the capacitor may be electrically connected to the external circuit by a connection of wires to the electrodes of the capacitor. The micro-coil may be used to excite magnetic resonance of electrons or nuclei in a magnetic field which is constant with time or is slowly varying with time in comparison to the magnetic field generated by the coil, thereby causing a change in electrical impedance of the coil which can be detected by the external circuit.

Figure 5:
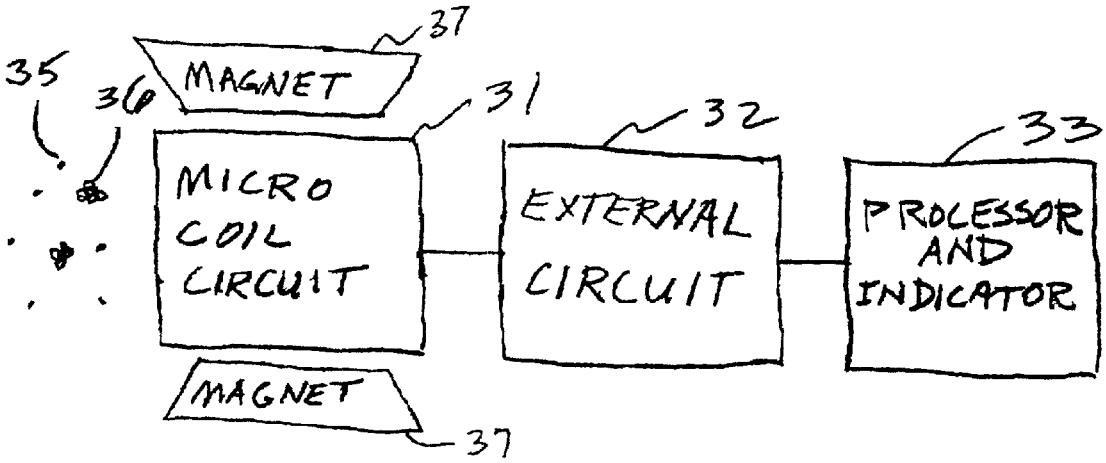
FIG. 5 is a system layout for a device incorporating a micro-resonant circuit used for detecting and identifying electrons and nuclei.

FIG. 5 shows a circuit 31 for identifying matter by exciting the magnetic resonance of electrons 35 or nuclei 36. Magnet 37 provides the field across micro-coil circuit 31. An external circuit 32 detects and measures the change of impedance of the micro-coil circuit 31. This impedance information is fed to processor and indicator 33 so that identification of the detected matter can be achieved.

Figure 6:
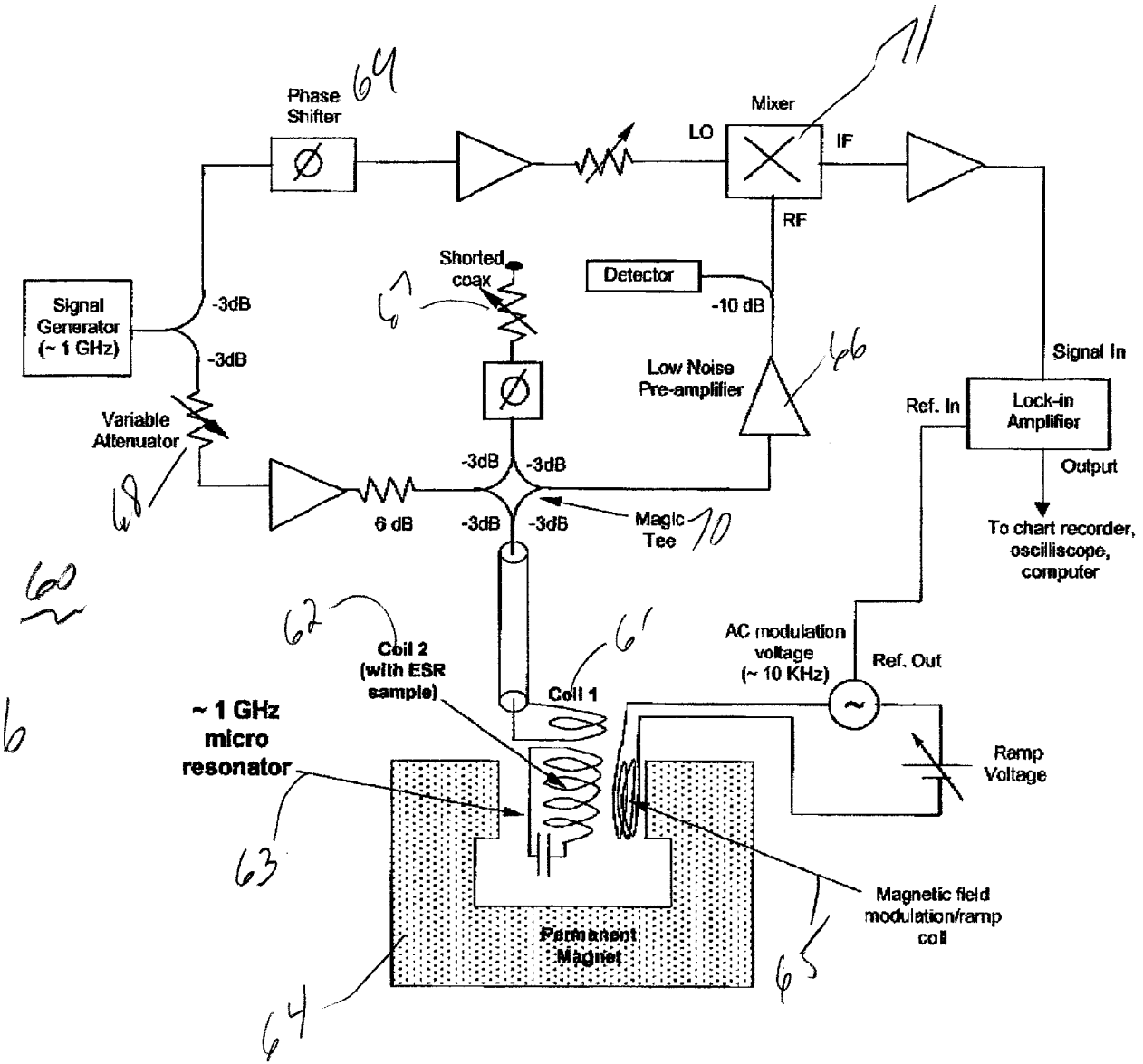
FIG. 6 is a circuit diagram of a prior art spectrometer circuit into which the present invention has been inserted to provide an improved performance.

A more detailed understanding of the present invention in use with an external circuit, 60 generally, can be seen in FIG. 6. The spectrometer circuit shown in FIG. 6 shows micro coils 61 and 62 connected to a homodyne spectrometer whose basic design is well known in the art. The spectrometer is designed for detection of electron spin resonance (ESR) in low magnetic fields (resonance frequency approximately 1 GHz). The ESR sample is contained in micro coil 62, which together with an on-chip capacitor, forms a micro resonator 63. RF power from the signal generator is coupled into coil 62 from coil 61 by inductive coupling. The RF magnetic field in coil 62 can cause the electron spins to flip their orientation in the external field produced by the permanent magnet 64 and the modulation/ramp coil 65. Significant flipping of the electron spins occurs only when the frequency of the RF magnetic field in micro coil 62 and the slowly varying magnitude of the magnetic field produced by the permanent magnet 64 and the modulation/ramp coil 65 satisfy the electron spin resonance condition. When the electron spin resonance condition is satisfied, the electrons absorb energy from micro coil 62, changing its impedance, and hence changing the impedance seen looking into coil 61 from the external circuit. This results in a change in reflected RF power from coil 61, and a change in voltage at the input of the low noise pre-amplifier 66. The shorted coax 67, variable attenuator 68 and phase shifter 69 connected to the magic tee 70 are tuned to null out the reflected voltage from micro coil 61 when the ESR resonance condition is not satisfied, so that the RF voltage present at the low noise preamplifier 66 input is very small. The mixer 71 down-converts the output of the low noise preamplifier 66 to produce an intermediate frequency (IF) signal at the AC modulation frequency of the slowly varying magnetic field. This audio frequency signal is down-converted to DC by a lock-in amplifier 72, for display and storage of the ESR signal amplitude and phase.

The spectrometer circuit can be modified for nuclear magnetic resonance (NMR) detection by using lower frequency RF components suitable for the typically lower NMR resonant frequency. Pulsed magnetic resonance detection is also possible by applying one or more RF pulses to micro coil 61, rather than applying continuous RF power. The RF pulses produce a rotating magnetization of the sample in micro coil 62 which induces a signal voltage in micro coil 61 and the low noise preamplifier 66. The RF signal voltage is down-converted by the mixer 71 and observed at the IF output of the mixer 71, after appropriate filtering and amplification.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A micro-coil device comprising:

a first silicon wafer having a trench defining an inductive cavity, said trench having metal formed therein;

a second silicon wafer having at least one hole therein for providing a non metallic path for magnetic flux to exit said inductive cavity without passing through either said first or said second silicon wafer;

a first metal formed on said first wafer and having a first pad connected thereto; and a second metal formed on said second wafer and having a second pad connected thereto; wherein said first and second wafers are proximate to each other and connected at one end to form a first coil situated between said first and second wafers and having at least one turn, said coil being formed around an inductive cavity having a diameter that is equal to or less than a thickness of said first wafer;

said device including a third metal formed on said first wafer; and a fourth metal formed on said second wafer;

wherein said third and fourth metals being first and second electrodes of a capacitor said coil and capacitor being interconnected to form a resonant circuit;

said device further including a second coil situated between said first and second wafers wherein said second coil is inductively coupled to the first coil and one of said first and second coils is connected to an external circuit.

2. The device of claim 1, wherein said first coil is for exciting magnetic resonance of electrons or nuclei in a first magnetic field which is constant or slowly varying with time in comparison to a second magnetic field generated by said first coil.

3. The device of claim 2, wherein the external circuit is for measuring impedance of said first coil and said second coil is connected to said external circuit.

4. The device of claim 1, further including a processor connected to said external circuit.

5. The device of claim 4, wherein said external circuit and processor is formed on said wafer.

6. The device of claim 5, wherein said external circuit and said inductor form a magnetic resonance spectrometer circuit.

7. A micro-coil device comprising:

first silicon wafer means for providing a bottom wafer having a trench means for defining an inductive cavity, said trench means having metal formed therein;

second silicon wafer means for providing an upper wafer having at least one hole therein for providing a non metallic path for magnetic flux to exit said inductive cavity without passing through either said first or said second silicon wafer means;

a first metal formed on said first wafer means and having first pad means for conducting current connected thereto; and a second metal formed on said second wafer means and having second pad means for conducting current connected thereto; wherein said first and second wafer means are proximate to each other and connected at one end to form a first coil means for carrying current and situated between said first and second wafer means and having at least one turn, said coil means being formed around an inductive cavity having a diameter that is equal to or less than a thickness of said first wafer means;

said device including a third metal formed on said first wafer means; and a fourth metal formed on said second wafer means; wherein said third and fourth metals being first and second electrodes of a capacitor means for resonant cooperation with said coil means, said coil and capacitor being interconnected to form a resonant circuit;

said device further including a second coil means for inductive coupling with said first coil means, said second coil means being situated between said first and second wafer means wherein said second coil means is inductively coupled to the first coil means and one of said first and second coil means is connected to an external circuit.

8. The device of claim 7, wherein said first coil means is for exciting magnetic resonance of electrons or nuclei in a first magnetic field which is constant or slowly varying with time in comparison to a second magnetic field generated by said first coil.

9. The device of claim 7, wherein the external circuit is for measuring impedance of said first coil and said second coil is connected to said external circuit.

10. The device of claim 7, further including a processor connected to said external circuit.

11. The device of claim 10, wherein said external circuit and processor is formed on said wafer.

12. The device of claim 11, wherein said external circuit and said inductor form a magnetic resonance spectrometer circuit.

13. In a magnetic resonance spectrometer device having a first and second coil forming a microresonator, and a permanent magnet associated with said microresonator, in which electron spin resonance is detected in low magnetic fields, the improvement comprising:

a first coil in said microresonator comprising:

a first silicon wafer having a trench defining an inductive cavity, said trench having metal formed therein;

a second silicon wafer having at least one hole therein for providing a non metallic path for magnetic flux to exit said inductive cavity without passing through either said first or said second silicon wafer;

a first metal formed on said first wafer and having a first pad connected thereto; and a second metal formed on said second wafer and having a second pad connected thereto; wherein said first and second wafers are proximate to each other and connected at one end to form a first coil situated between said first and second wafers and having at least one turn, said coil being formed around an inductive cavity having a diameter that is equal to or less than a thickness of said first wafer, said device including a third metal formed on said first wafer, and a fourth metal formed on said second wafer; wherein said third and fourth metals being first and second electrodes of a capacitor said coil and capacitor being interconnected to form a resonant circuit;

said device further including a second coil situated between said first and second wafers wherein said second coil is inductively coupled to the first coil and one of said first and second coils is connected to an external circuit.

14. The device of claim 13, further including a processor connected to said external circuit, said processor being formed on said wafer.

15. The device of claim 13, wherein the external circuit is for measuring impedance of said first coil and said second coil is connected to said external circuit.

* * * * *